US005982159A

United States Patent [19]

Janczak et al.

[11] Patent Number: 5,982,159

[45] Date of Patent: Nov. 9, 1999

[54] DIMMABLE, SINGLE STAGE FLUORESCENT LAMP

[75] Inventors: Jerzy Janczak, Woodhaven, N.Y.; Pawel M. Gradzki, Potomac, Md.

[73] Assignee: Philips Electronics North America Corporation, New York, N.Y.

[21] Appl. No.: 09/062,170

[22] Filed: Apr. 17, 1998

Related U.S. Application Data

[63] Continuation-in-part of application No. 09/034,441, Mar. 4, 1998, and application No. 08/903,567, Jul. 31, 1997, Pat. No. 5,917,717.

[51] Int. Cl.[6] ..... G05F 1/40; H05B 37/02

[52] U.S. Cl. ..... 323/282; 323/908; 315/247

[58] Field of Search ..... 323/282, 908; 363/89; 315/219, 247, 159, 291, 307, 7, 308

[56] References Cited

U.S. PATENT DOCUMENTS

| | | | |
|---|---|---|---|
| 4,375,608 | 3/1983 | Kohler | 315/307 |
| 4,511,823 | 4/1985 | Eaton et al. | 315/226 |
| 4,782,268 | 11/1988 | Fahnrich et al. | 315/200 R |
| 4,808,887 | 2/1989 | Fuhnrich et al. | 315/247 |
| 5,303,140 | 4/1994 | Shimizu | 363/132 |
| 5,412,287 | 5/1995 | Shackle | 315/247 |
| 5,521,467 | 5/1996 | Statnic et al. | 315/247 |

FOREIGN PATENT DOCUMENTS

| | | |
|---|---|---|
| WO9607297 | 3/1996 | WIPO . |

*Primary Examiner*—Shawn Riley
*Assistant Examiner*—Rajnikant B. Patel
*Attorney, Agent, or Firm*—Bernard Franzblau

[57] ABSTRACT

A dimmable fluorescent lamp including a feedback circuit for drawing sufficient current to maintain an appropriate charge across the buffer capacitor. A bypass capacitor provides a path for diverting a portion of the power which would otherwise be fed back to the buffer capacitor during low level dimming. Consequently, overboost voltages across the buffer capacitor during low level dimming are substantially reduced.

21 Claims, 3 Drawing Sheets

DIMMABLE, SINGLE STAGE FLUORESCENT LAMP

CROSS-REFERENCE TO RELATED APPLICATION

This aplication is a continuation-in-part of both application Ser. No. 08/903,567, filed Jul. 31, 1997, now U.S. Pat. No. 5,917,717 and of application Ser. No. 09/034,441, filed Mar. 4, 1998, currently pending.

BACKGROUND OF THE INVENTION

This invention relates generally to a ballast for a fluorescent lamp, and more particularly to a dimmable, single stage fluorescent lamp.

A conventional single stage fluorescent lamp, such as disclosed in PCT Patent Application No. WO 96/07297, includes a ballast having an output (i.e. inverter) stage. No additional stage, such as a switch mode power supply, is required in maintaining a sufficient D.C. voltage across a buffer capacitor. Instead, the lamp ballast includes a feedback path for drawing sufficient current from the ballast input to maintain an appropriate charge across the buffer capacitor.

Many lamp ballasts are not designed for dimming. Unacceptably high overboost voltages can occur across the buffer capacitor during low level triac dimming (e.g. at about 10% of full light output) due to too much power fed back to the buffer capacitor through the feedback path.

Accordingly, it is desirable to provide an improved dimmable fluorescent lamp in which the amount of power fed back to the buffer capacitor during low level dimming is reduced. The improved dimmable fluorescent lamp, in particular, should substantially reduce overboost voltages across the buffer capacitor during low level dimming.

SUMMARY OF THE INVENTION

Generally speaking, in accordance with a first aspect of the invention, a ballast for powering a lamp load includes a buffer capacitor, a first serial combination of two switches joined together at a first junction and connected in parallel across the buffer capacitor and a second serial combination of an inductor and capacitor joined together at a second junction and coupled at one end to the first junction with the lamp load connected in parallel with the capacitor. The ballast also includes a feedback circuit coupled to the other end of the second serial combination for supplying a high frequency signal to the buffer capacitor, and a bypass circuit coupling the second junction to a junction joining the first serial combination of two switches and the buffer capacitor together.

The bypass capacitor provides a path for diverting a portion of the power which would otherwise be fed back to the capacitor during low level dimming. Consequently, overboost voltages across the buffer capacitor during low level dimming are substantially reduced.

It is a feature of the invention that the ballast also includes a serial combination of a diode and a feedback capacitor connected in parallel with the buffer capacitor. The feedback circuit can include the combination of discrete inductive and capacitive components. The ballast typically powers a lamp load consisting of a fluorescent lamp.

In accordance with a second aspect of the invention, a ballast for powering a lamp load includes a buffer capacitor, a first serial combination of two switches joined together at a first junction and connected in parallel with the buffer capacitor and a second serial combination of an inductor and capacitor joined together at a second junction. The second serial combination has one end coupled to the first junction and another end coupled to a junction joining the first serial combination of two switches and buffer capacitor together with one end of the lamp load connected to the second junction. A feedback circuit is connected to the other end of the lamp load for supplying a high frequency signal to the buffer capacitor. The ballast typically powers the lamp load of a fluorescent lamp.

Accordingly, it is an object of the invention to provide an improved dimmable, single stage fluorescent lamp in which the amount of power being fed back to the ballast buffer capacitor is reduced during low dim levels.

It is another object of the invention to provide an improved dimmable, single stage fluorescent lamp in which overboost voltages across the ballast buffer capacitor are substantially reduced during low dim levels.

Still other objects and advantages of the invention, will, in part, be obvious and will, in part, be apparent from the specification.

The invention accordingly comprises several steps in a relation of one or more of such steps with respect to each of the others, and the device embodying features of construction, a combination of elements and arrangement of parts which are adapted to effect such steps, all as exemplified in the following detailed disclosure and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENT

Figure 1:
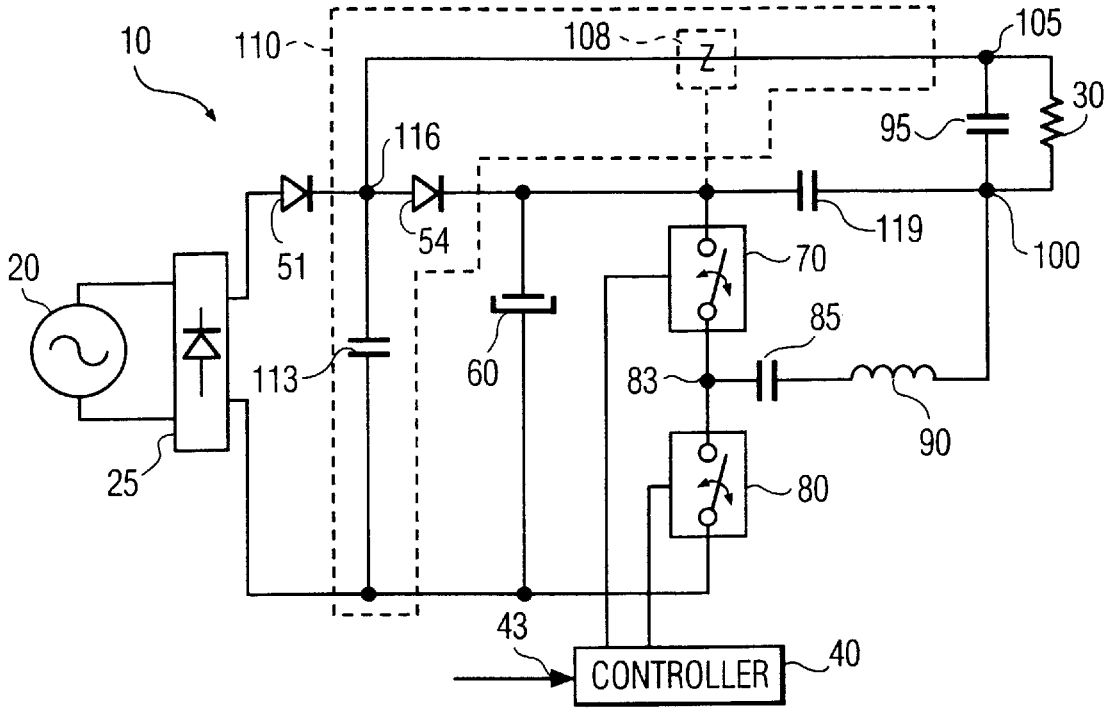
FIG. 1 is a partial block diagram and partial schematic of a dimmable, single stage fluorescent lamp in accordance with a first embodiment of the invention.

As shown in FIG. 1, a fluorescent lamp 10 is powered from an A.C. power line represented by an A.C. source 20. The desired level of illumination of a lamp 30 is set by a controller 40 in response to a varying D.C. voltage applied to an input 43.

A full bridge rectifier 25 rectifies the low frequency, sinusoidal A.C. voltage supplied by A.C. source 20. A pair of fast switching diodes 51 and 54 applies this rectified, sinusoidal A.C. voltage to a buffer (e.g. an electrolytic) capacitor 60. Buffer capacitor 60 filters the sinusoidal voltage into a substantially constant D.C. voltage supplied to an inverter.

An inverter is configured as a half-bridge and includes the serial combination of switches (e.g. power MOSFETs) 70 and 80 connected in series across buffer capacitor 60. Switches 70 and 80 are joined together at a junction 83 and commonly identified as forming a totem pole arrangement. The switching states of the MOSFETs, serving as switches 70 and 80, are controlled by controller 40.

A serial combination of an inductor 90 and a shunt capacitor 95 are joined at a junction 100 and coupled at one end through a D.C. blocking capacitor 85 to junction 83. Lamp 30 is connected in parallel across shunt capacitor 95. A feedback circuit 110 is coupled to an end 105 of the serial combination of inductor 90 and capacitor 95

Figure 3:
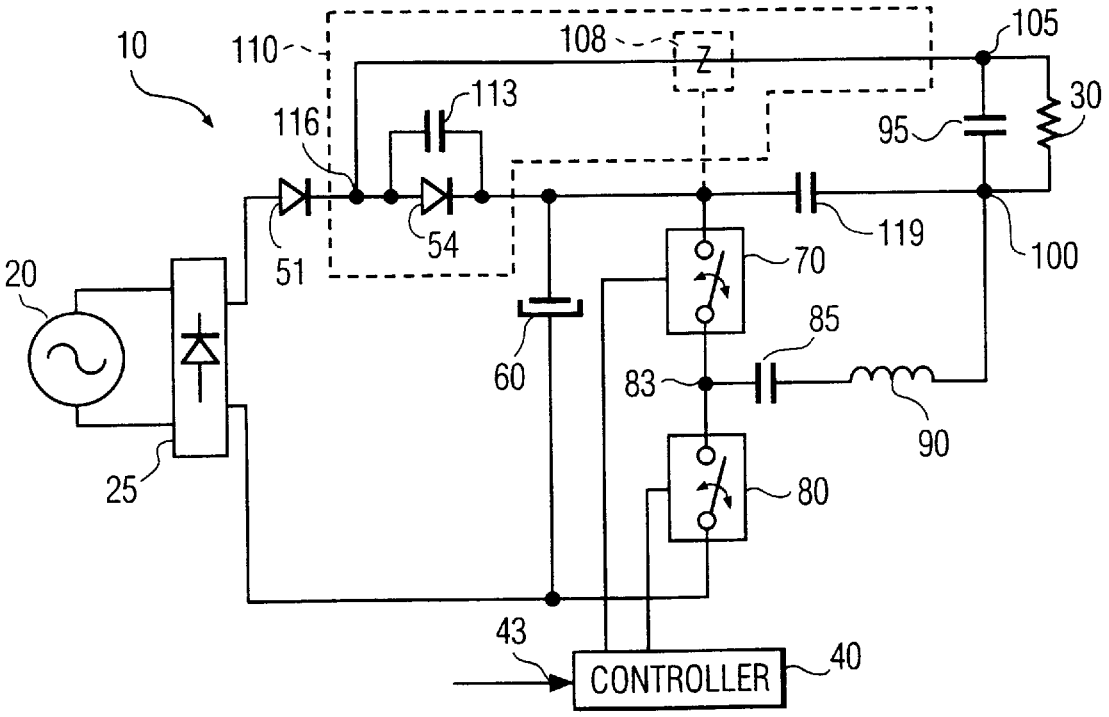
FIG. 3 is a partial block diagram and partial schematic of a dimmable, single stage fluorescent lamp in accordance with a third embodiment of the invention.
Figure 5:
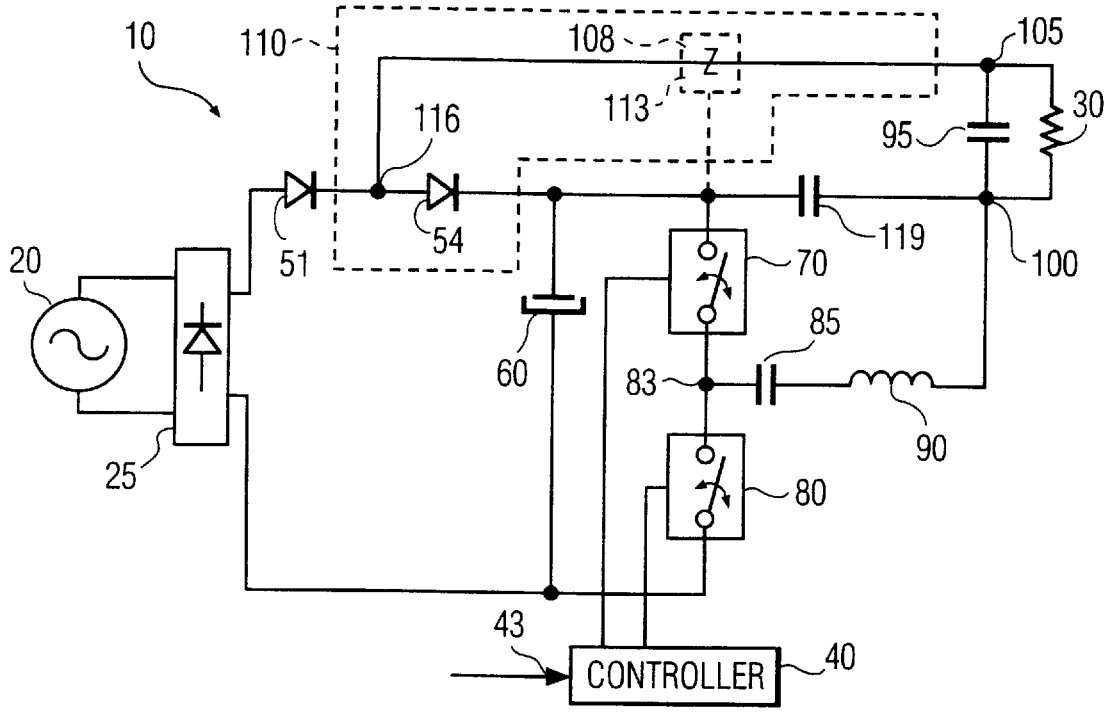
FIG. 5 is a partial block diagram and partial schematic of a dimmable, single stage fluorescent lamp in accordance with a fourth embodiment of the invention.

Power feedback circuit 110 includes a feedback capacitor 113 connected between a junction 116 joining the cathode of diode 51 to the anode of diode 54. The serial combination of diode 54 and feedback capacitor 113 are connected in parallel across buffer capacitor 60. Alternatively, as shown in FIG. 3, feedback capacitor 113 can be connected in parallel with diode 54. A short circuit is connected between the end 105 and junction 116. Alternatively, as shown in dashed lines, an impedance 108 including a combination of one or more inductors and capacitors including, if desired, feedback capacitor 113 (as shown in FIG. 5), can be connected between end 105 and junction 116 in order to increase the impedance of circuit 110 to substantially reduce an overboost voltage across buffer capacitor 60. A bypass circuit, which includes an impedance such as, but not limited to, a capacitor 119, is coupled between junction 100 and the junction joining the serial combination of switches 70 and 80 and buffer capacitor 60 together.

In operation, controller 40 drives the switching frequency of switches 70 and 80 based on the illumination level corresponding to the D.C. voltage applied to an input 43. Power at a high frequency of between about 50 kHz to 85 kHz is delivered to lamp 30 by a resonant circuit formed by inductor 90, capacitors 119, 95 and 113 and lamp 30. In an alternative embodiment, the resonant circuit includes impedance 108. At low dim levels of, for example, 10% of full lamp output, a portion of the power delivered is diverted away from feedback circuit 110 by capacitor 119. This same resonant circuit controls the amount of power fed back to buffer capacitor 60. Consequently, overboost voltages across the buffer capacitor during low level dimming are substantially reduced.

Figure 2:
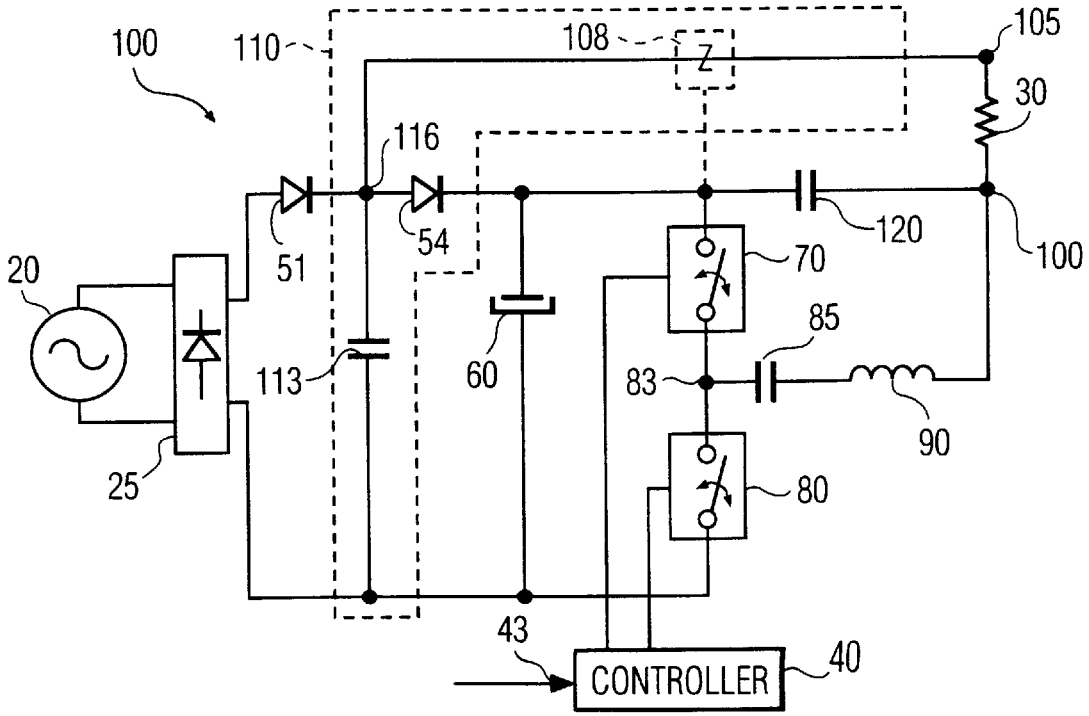
FIG. 2 is a partial block diagram and partial schematic of a dimmable, single stage fluorescent lamp in accordance with a second embodiment of the invention.
Figure 4:
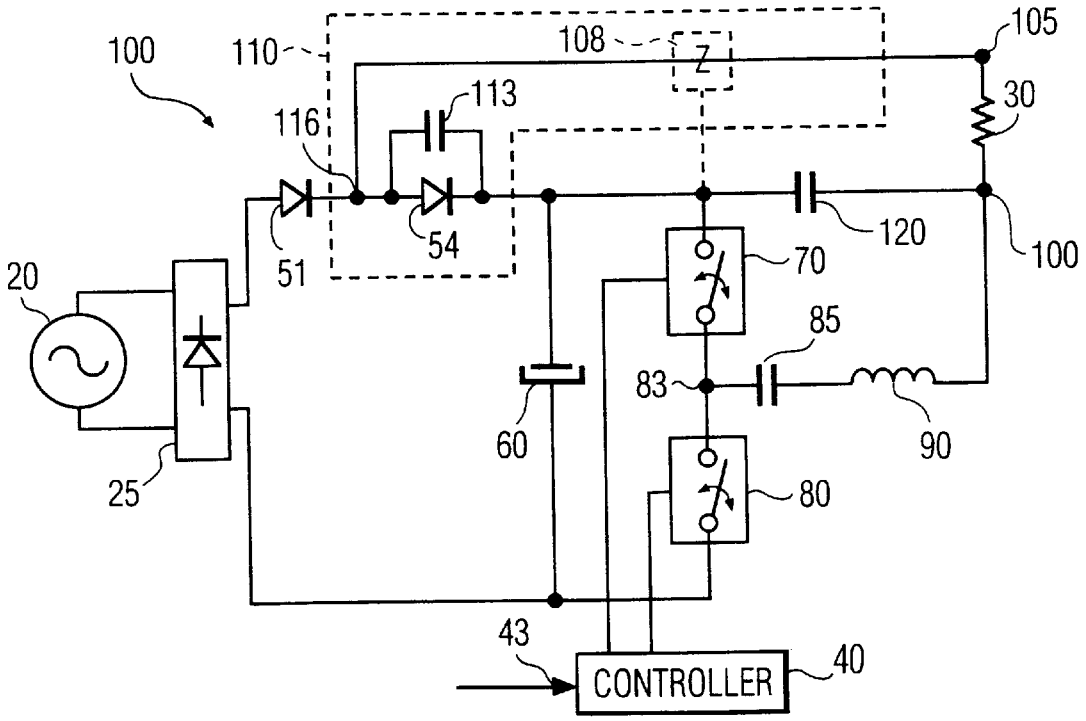
FIG. 4 is a partial block diagram and partial schematic of a dimmable, single stage fluorescent lamp in accordance with a forth embodiment of the invention.
Figure 6:
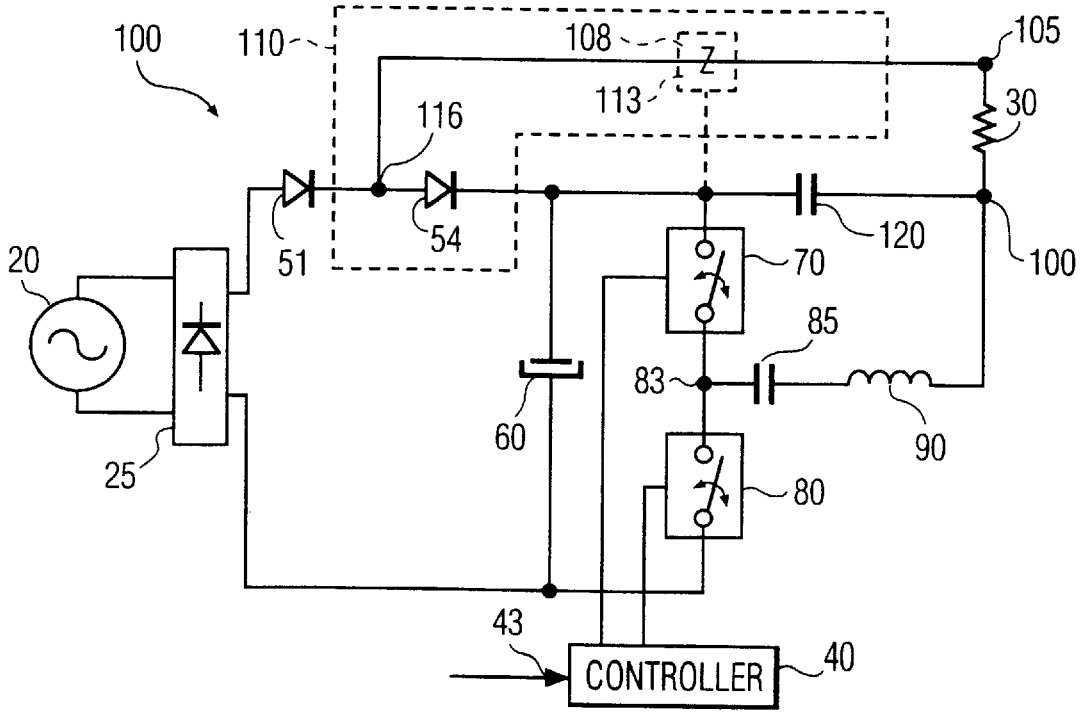
FIG. 6 is a partial block diagram and partial schematic of a dimmable, single stage fluorescent lamp in accordance with a fourth embodiment of the invention.

In accordance with another embodiment of the invention, as shown in FIG. 2, a capacitor 120 serves ;as both bypass capacitor 119 and shunt capacitor 95. In the alternative embodiment, the common resonant circuit would also include impedance 108. In all embodiments, a single inductor (choke) 90 can be used to minimize the number of parts and manufacturing cost. FIGS. 4 and 6 are similar to FIGS. 3 and 5 except that the incorporate capacitor 120 rather than bypass capacitor 119 and shunt capacitor 95, respectively.

As can now be readily appreciated, bypass capacitor 119 or 120 provides a path for diverting a portion of the power which would otherwise be fed back to buffer capacitor 60 during low level dimming. Consequently, overboost voltages across buffer capacitor 60 during low level dimming are substantially reduced.

It will thus be seen that the objects set forth above and those made apparent from the preceding description are efficiently attained and, since certain changes can be made in the above method and construction set forth without departing from the spirit and scope of the invention, it is intended that all matter contained in the above description and shown in the accompanying drawings shall be interpreted as illustrative and not in a limiting sense.

It is also to be understood that the following claims are intended to cover all the generic and specific features of the invention herein described and all statements of the scope of the invention, which as a matter of language, might be said to fall therebetween.

We claim:

1. A ballast for powering a lamp load, comprising:

a buffer capacitor;

a first serial combination of two switches joined together at a first junction and connected in parallel across the buffer capacitor;

a second serial combination of an inductor and capacitor joined together at a second junction and coupled at one end to the first junction and with the lamp load connected in parallel with the capacitor;

a feedback circuit coupled to the other end of the second serial combination for supplying a high frequency signal to the buffer capacitor; and a bypass circuit coupling the second junction to a junction joining together the first serial combination and the buffer capacitor.

2. The ballast of claim 1, wherein the feedback circuit includes a serial combination of a fast switching diode and a feedback capacitor in parallel with the buffer capacitor.

3. The ballast as claimed in claim 2 wherein said inductor, said capacitor and said feedback capacitor are chosen so that they form a resonant circuit.

4. The ballast of claim 1, wherein the feedback circuit includes the combination of discrete inductive and capacitive components.

5. The ballast of claim 1, wherein the feedback circuit includes a parallel combination of a fast switching diode and a feedback capacitor in parallel with the buffer capacitor.

6. The ballast as claimed in claim 1 wherein the bypass circuit comprises a second capacitor which diverts away a portion of power which otherwise would be fed back to the buffer capacitor during low level dimming of the lamp load.

7. The ballast as claimed in claim 1 wherein the feedback circuit further comprises a series connected impedance means in order to increase the impedance of the feedback circuit and thereby limit voltage across the buffer capacitor.

8. The ballast as claimed in claim 1 further comprising a rectifier circuit coupled to a source of low frequency AC voltage and having a DC output terminal, and said feedback circuit includes a diode connected in series circuit with the buffer capacitor to said DC output terminal, and a feedback capacitor connected in parallel with said series circuit.

9. The ballast as claimed in claim 1 wherein said feedback circuit comprises an impedance element and a feedback capacitor connected in series circuit with a diode between said other end of the serial combination and the buffer capacitor.

10. The ballast as claimed in claim 1 wherein the feedback circuit comprises a parallel connection of a diode and a feedback capacitor connected in series with the buffer capacitor to first and second DC supply voltage terminals for the ballast.

11. The ballast as claimed in claim 1 wherein said feedback circuit is the only source of power feedback for the buffer capacitor.

12. A fluorescent lamp having a ballast for powering a lamp load, comprising:

a buffer capacitor;

a first serial combination of two switches joined together at a first junction and connected in parallel across the buffer capacitor;

a second serial combination of an inductor and capacitor joined together at a second junction and coupled at one end to the first junction and with the lamp load connected in parallel with the capacitor;

a feedback circuit coupled to the other end of the second serial combination for supplying a high frequency signal to the buffer capacitor; and a bypass circuit coupling the second junction to a junction joining together the first serial combination and the buffer capacitor.

13. A ballast for powering a lamp load, comprising:

a buffer capacitor;

a first serial combination of two switches joined together at a first junction and connected in parallel with the buffer capacitor;

a second serial combination of an inductor and a capacitor joined together at a second junction and having one end coupled to the first junction and having another end coupled to a junction joining the first serial combination of two switches and the buffer capacitor together and with one end of the lamp load connected to the second junction; and a feedback circuit connected to the other end of the lamp load for supplying a high frequency signal to the buffer capacitor.

14. The ballast of claim 13, wherein the feedback circuit includes a serial combination of a fast switching diode and a feedback capacitor in parallel with the buffer capacitor.

15. The ballast as claimed in claim 14 wherein said inductor, said capacitor and said feedback capacitor are chosen so that they form a resonant circuit.

16. The ballast of claim 13, wherein the feedback circuit includes a parallel combination of a fast switching diode and a feedback capacitor in parallel with the buffer capacitor.

17. The ballast as claimed in claim 13 wherein said capacitor provides a dual function as an element of the second serial combination and as a bypass circuit coupling the second junction to a junction joining together the first serial combination and the buffer capacitor.

18. The ballast as claimed in claim 13 wherein said feedback circuit comprises an impedance element and a feedback capacitor connected in series circuit with a diode between said other end of the lamp load and the buffer capacitor.

19. A fluorescent lamp having a ballast for powering a lamp load, comprising:

a buffer capacitor;

a first serial combination of two switches joined together at a first junction and connected in parallel across the buffer capacitor;

a second serial combination of an inductor and a capacitor joined together at a second junction having one end coupled to the first junction and having another end coupled to a junction joining the first serial combination of two switches and the buffer capacitor together and with one end of the lamp load connected to the second junction; and a feedback circuit connected to the other end of the lamp load for supplying a high frequency signal to the buffer capacitor.

20. The ballast of claim 19, further including a serial combination of a diode and a feedback capacitor in parallel with the buffer capacitor.

21. The ballast of claim 19, further including a parallel combination of a diode and a feedback capacitor in parallel with the buffer capacitor.

* * * * *